US007481048B2

(12) United States Patent
Harmon et al.

(10) Patent No.: US 7,481,048 B2
(45) Date of Patent: Jan. 27, 2009

(54) REGENERATION ASSEMBLY

(75) Inventors: Michael P. Harmon, Dunlap, IL (US); Cho Y. Liang, Henderson, NV (US); Gregory J. Kaufmann, Metamora, IL (US); Mari Lou Balmer-Millar, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/170,318

(22) Filed: Jun. 30, 2005

(65) Prior Publication Data

US 2007/0000242 A1 Jan. 4, 2007

(51) Int. Cl.
*F01N 3/10* (2006.01)

(52) U.S. Cl. ..... 60/303; 60/274; 60/286; 60/289; 60/295; 60/297; 60/311

(58) Field of Classification Search ..... 60/274, 60/286, 289, 295, 299, 303
See application file for complete search history.

(56) References Cited

U.S. PATENT DOCUMENTS 3,736,747 A 6/1973 Warren
4,004,414 A 1/1977 Melchior et al.
4,383,411 A 5/1983 Riddel
4,498,288 A 2/1985 Vogt
4,502,278 A 3/1985 Stark
4,571,938 A * 2/1986 Sakurai ..... 60/303
4,581,981 A 4/1986 Kusiak
4,589,254 A 5/1986 Kume et al.
4,615,173 A * 10/1986 Usui et al. ..... 60/286
4,622,810 A 11/1986 Shinsei et al.
4,622,811 A 11/1986 Distel et al.
4,651,524 A 3/1987 Brighton
4,677,823 A 7/1987 Hardy
4,711,087 A 12/1987 Kawamura
4,730,455 A 3/1988 Pischinger et al.
4,840,028 A 6/1989 Kusuda et al.
4,887,426 A 12/1989 Goerlich
4,912,920 A * 4/1990 Hirabayashi ..... 60/303
4,936,093 A 6/1990 Goerlich
4,944,153 A 7/1990 Goerlich et al.
4,951,464 A * 8/1990 Eickhoff et al. ..... 60/303
4,955,183 A 9/1990 Kolodzie et al.
4,987,738 A 1/1991 Lopez-Crevillen et al.
4,991,396 A 2/1991 Goerlich et al.
5,001,899 A 3/1991 Santiago et al.
5,038,562 A * 8/1991 Goerlich ..... 60/274

(Continued)

FOREIGN PATENT DOCUMENTS

JP 2001227323 A 8/2001

(Continued)

OTHER PUBLICATIONS

"APBF-DEC: Diesel-Fueled ECS Management Burner," http://www.southwestresearchinstitute.com/, Jun. 2005.

*Primary Examiner*—Thomas Denion
*Assistant Examiner*—Diem Tran
(74) *Attorney, Agent, or Firm*—Finnegan, Henderson, Farabow, Garrett & Dunner

(57) ABSTRACT

A regeneration assembly includes a first portion including a combustion chamber connected to a combustor head. The regeneration assembly also includes a second portion including a housing. The first portion is removably connectable to the second portion.

42 Claims, 4 Drawing Sheets

U.S. PATENT DOCUMENTS 5,044,158 A 9/1991 Goerlich
5,052,178 A 10/1991 Clerc et al.
5,063,737 A 11/1991 Lopez-Crevillen et al.
5,079,917 A 1/1992 Henkel
5,094,075 A 3/1992 Berendes
5,140,814 A 8/1992 Kreutmair et al.
5,211,009 A 5/1993 Houben et al.
5,243,819 A 9/1993 Woomer et al.
5,320,523 A 6/1994 Stark
5,347,809 A 9/1994 Moeckel et al.
5,417,059 A 5/1995 Härtel et al.
5,419,121 A 5/1995 Sung et al.
5,425,233 A * 6/1995 Ma et al. ..... 60/274
5,456,079 A * 10/1995 Langen ..... 60/286
5,457,945 A 10/1995 Adiletta
5,489,319 A 2/1996 Tokuda et al.
5,571,484 A * 11/1996 Pettit et al. ..... 422/173
5,771,683 A 6/1998 Webb
5,826,428 A 10/1998 Blaschke
5,829,248 A 11/1998 Clifton
5,879,148 A 3/1999 Cheng et al.
5,950,420 A * 9/1999 Geiger ..... 60/274
6,530,215 B2 * 3/2003 Alkemade et al. ..... 60/286
6,694,727 B1 2/2004 Crawley et al.
6,729,562 B2 5/2004 Bui
6,895,745 B2 5/2005 Roby
2004/0013579 A1 1/2004 Schaller
2005/0000209 A1 1/2005 Takahashi et al.

FOREIGN PATENT DOCUMENTS

WO WO 2004/101965 A1 11/2004

* cited by examiner

REGENERATION ASSEMBLY

TECHNICAL FIELD

The present disclosure is directed to a regeneration assembly and, more particularly, to a regeneration assembly configured to increase the temperature of exhaust gases directed to a particulate trap.

BACKGROUND

Engines, including diesel engines, gasoline engines, natural gas engines, and other engines known in the art, may exhaust a complex mixture of air pollutants. The air pollutants may be composed of both gaseous and solid material, such as, for example, particulate matter. Particulate matter may include ash and unburned carbon particles called soot.

Due to increased environmental concerns, some engine manufacturers have developed systems to treat engine exhaust after it leaves the engine. Some of these systems employ exhaust treatment devices such as particulate traps to remove particulate matter from the exhaust flow. A particulate traps may include filter material designed to capture particulate matter. After an extended period of use, however, the filter material may become partially saturated with particulate matter, thereby hindering the particulate trap's ability to capture particulates.

The collected particulate matter may be removed from the filter material through a process called regeneration. A particulate trap may be regenerated by increasing the temperature of the filter material and the trapped particulate matter above the combustion temperature of the particulate matter, thereby burning away the collected particulate matter. This increase in temperature may be effectuated by various means. For example, some systems may employ a heating element to directly heat one or more portions of the particulate trap (e.g., the filter material or the external housing). Other systems have been configured to heat exhaust gases upstream of the particulate trap. The heated gases then flow through the particulate trap and transfer heat to the filter material and captured particulate matter. Such systems may alter one or more engine operating parameters, such as the ratio of air to fuel in the combustion chambers, to produce exhaust gases with an elevated temperature. Alternatively, such systems may heat the exhaust gases upstream of the particulate trap with, for example, a burner disposed within an exhaust conduit leading to the particulate trap.

One such system is disclosed by U.S. Pat. No. 4,651,524, issued to Brighton on Mar. 24, 1987 ("the '524 patent"). The '524 patent discloses an exhaust treatment system configured to increase the temperature of exhaust gases with a burner.

While the system of the '524 patent may increase the temperature of the particulate trap, the regeneration device of the '524 patent is not configured such that a portion of the device may be useable with other engine specific portions of the device having different sizes and shapes. Moreover, the regeneration device described therein may be too large to be installed as part of an engine package. As a result, it may be difficult to accurately calibrate the regeneration device and the engine system together as a unit.

The disclosed regeneration assembly is directed toward overcoming one or more of the problems set forth above.

SUMMARY OF THE INVENTION

In one exemplary embodiment of the present disclosure, a regeneration assembly includes a first portion having a combustion chamber connected to a combustor head. The regeneration assembly also includes a second portion including a housing. The first portion is removably connectable to the second portion.

In another exemplary embodiment of the present disclosure, a regeneration assembly includes a universal first portion including a combustion chamber connected to a combustor head. The combustion chamber defines a first combustion zone. The regeneration assembly also includes a second portion having a housing defining a second combustion zone. The combustion chamber of the universal first portion is disposed substantially within the housing. The first combustion zone is substantially isolated from the second combustion zone by a stabilizer connected to the combustion chamber.

In still another exemplary embodiment of the present disclosure, a method of regenerating a filter using a regeneration assembly includes injecting a flow of a combustible substance into a first combustion zone of the regeneration assembly, directing a flow of oxygen to the first combustion zone of the regeneration assembly, and partially combusting the combustible substance in the first combustion zone. The method also includes directing a flow of exhaust to a second combustion zone of the regeneration assembly and substantially completely combusting a remainder of the injected flow of the combustible substance in the second combustion zone.

DETAILED DESCRIPTION

Figure 1:
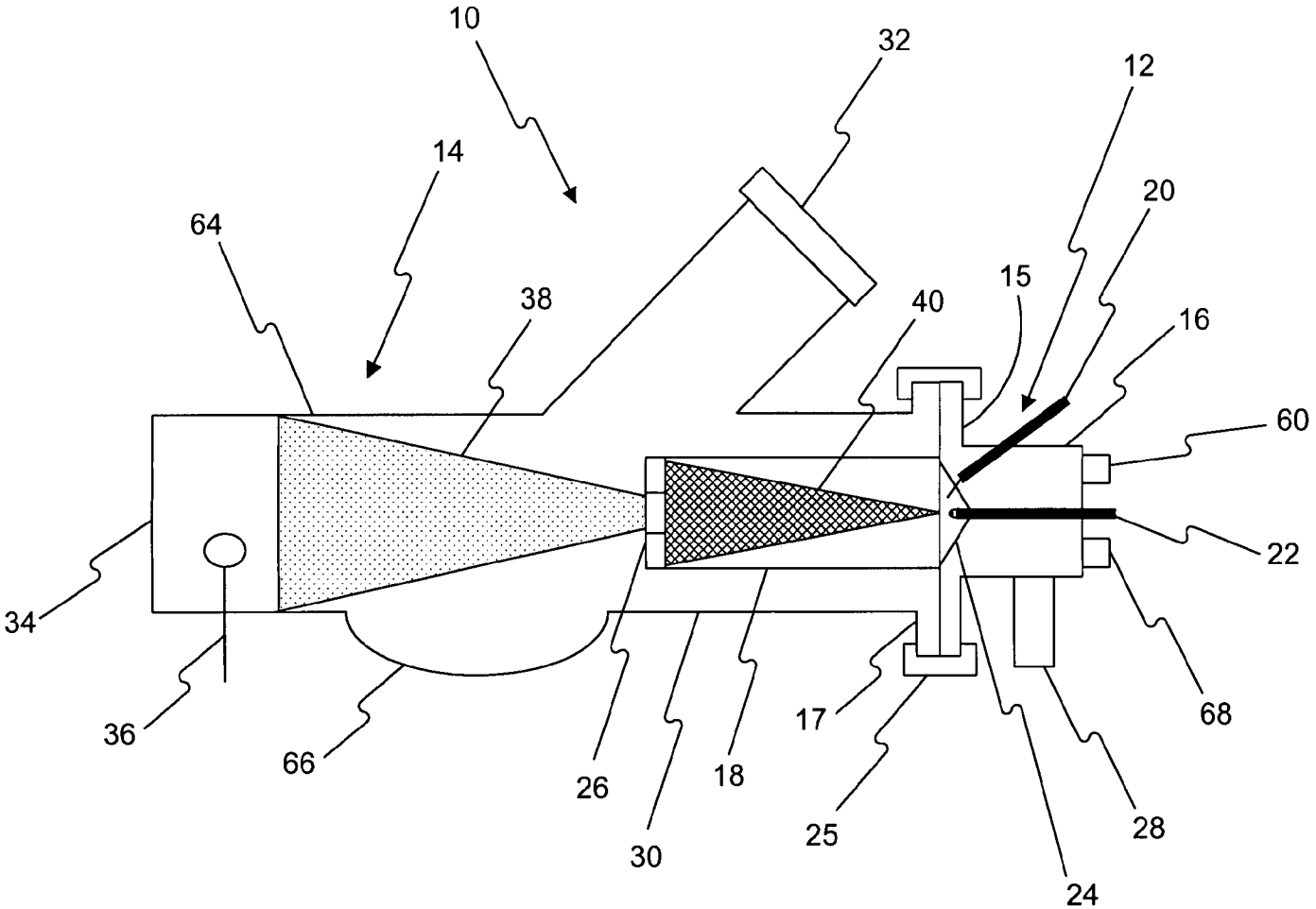
FIG. 1 is a diagrammatic illustration of a regeneration device according to an exemplary embodiment of the present disclosure.

As shown in FIG. 1, a regeneration assembly 10 according to an exemplary embodiment of the present disclosure may include a first portion 12 and a second portion 14. The first portion 12 may include a combustion chamber 18 connected to a combustor head 16. The first portion 12 may also include an igniter 20, an injector 22, a swirler 24 and a stabilizer 26. The second portion 14 may include a housing 30, and the housing 30 may include an exhaust inlet 32 and an outlet 34. The first portion 12 may be removably connectable to the second portion 14. As shown in FIG. 1, the regeneration assembly 10 may include a connection assembly 25 configured to assist in removably connecting the first portion 12 to the second portion 14. In addition, as will be described in greater detail below, the first portion 12 may be a universal first portion sized, shaped, and/or otherwise configured for use with second portions 14 having different sizes, shapes, and/or other configurations.

The combustor head 16 may be, for example, a manifold, a cap, and/or any other structure capable of supporting components of a regeneration assembly. As shown in FIG. 1, the igniter 20, the injector 22, and/or the swirler 24 may be mounted to and/or supported by the combustor head 16. The combustor head 16 may be made of any materials known in the art capable of withstanding particulate filter regeneration temperatures. Such materials may include, for example, platinum, steel, aluminum, and/or any alloys thereof. In addition, the combustor head 16 may be made of cast iron or any other cast material.

As shown in FIG. 1, the combustor head 16 may include a gas inlet 28. The combustor head 16 may be fluidly connected to the combustion chamber 18 and may be configured to direct a flow of gas from the gas inlet 28 to the combustion chamber 18. In one exemplary embodiment, the flow of gas may include ambient air, compressed air, and/or filtered engine exhaust. In addition, the combustor head 16 may further include, for example, a flange 15 and/or other structures configured to assist in removably coupling the combustor head 16 to the housing 30 of the regeneration assembly 10. The housing 30 may include a corresponding flange 17 configured to mate with the flange 15 of the combustor head 16. In such an embodiment, the connection assembly 25 may be configured to connect the flanges 15, 17. Although shown diagrammatically in FIG. 1, it is understood that the connection assembly 25 may include, for example, one or more band clamps, bolts, screws, ties, and/or other structures or devices capable of removably attaching and/or coupling two devices together. It is understood that in another embodiment of the present disclosure, one or both of the flanges 15, 17 may be omitted.

The combustion chamber 18 may be connected to the combustor head 16 and may be fluidly connected to any fluid passages or channels (not shown) of the combustor head 16 such that a gas entering the gas inlet 28 of the combustor head 16 may be directed to the combustion chamber 18. The combustion chamber 18 may be made of any high temperature corrosion resistant alloy known in the art such as, for example, Hastelloy®. Alternatively, the combustion chamber may be made of any of the metals and/or alloys mentioned above with respect to the combustor head 16. The combustion chamber 18 may be any size, shape, and/or configuration known in the art. As shown in FIG. 1, in an exemplary embodiment, the combustion chamber 18 may be substantially cylindrical and may be disposed substantially completely within the housing 30. The combustion chamber 18 may define a first combustion zone 40 within the housing 30. It is understood that it may be desirable to minimize the overall size of the regeneration assembly 10 and that minimizing the volume of the combustion chamber 18 may assist in minimizing the size of the regeneration assembly 10. The combustion chamber 18 may have any conventional wall thickness suitable for safely containing a combustion reaction.

The igniter 20 may be any device capable of igniting a combustible substance. In an exemplary embodiment of the present disclosure, the igniter 20 may include, for example, a spark plug, glow plug, plasma igniter, surface-type igniter, and/or any other ignition device known in the art. The type of igniter 20 used may depend on a variety of factors, including, for example, the desired speed and/or reliability with which the igniter 20 may ignite a combustible substance during use, the duration of ignitor firing, and the space limitations of the combustor head 16. The igniter 20 may be formed from materials resistant to, for example, fouling due to carbon deposits being formed on an electrode (not shown) of the igniter 20. The igniter 20 may be configured to ignite a combustible substance proximate the combustion chamber 18. The igniter 20 may also be configured to fire periodically to ignite the combustible substance being delivered to the combustion chamber 18 and may be configured to fire substantially continuously to assist in stabilizing the combustion process. It is understood that assisting in stabilizing the combustion process may include keeping a combustion flame burning with a substantially consistent intensity.

The injector 22 may be disposed within the combustor head 16 and may be configured to deliver a combustible substance to the combustion chamber 18. The injector 22 may be, for example, a pressure swirl, air assist, air blast, dual orifice, and/or any other type of injector known in the art. The injector 22 may include, for example, a nozzle, a fluid atomization device, and/or any other device capable of injecting and/or atomizing an injected fluid. In an exemplary embodiment, an end of the injector 22 may define a plurality of holes sized, positioned, and/or otherwise configured to facilitate the formation of a relatively fine mist and/or spray of injected fluid. The injector 22 may be configured to substantially evenly distribute the combustible substance within the combustion chamber 18. The injector 22 may also be configured to distribute the combustible substance at a desired angle within the combustion chamber 18.

Figure 4:
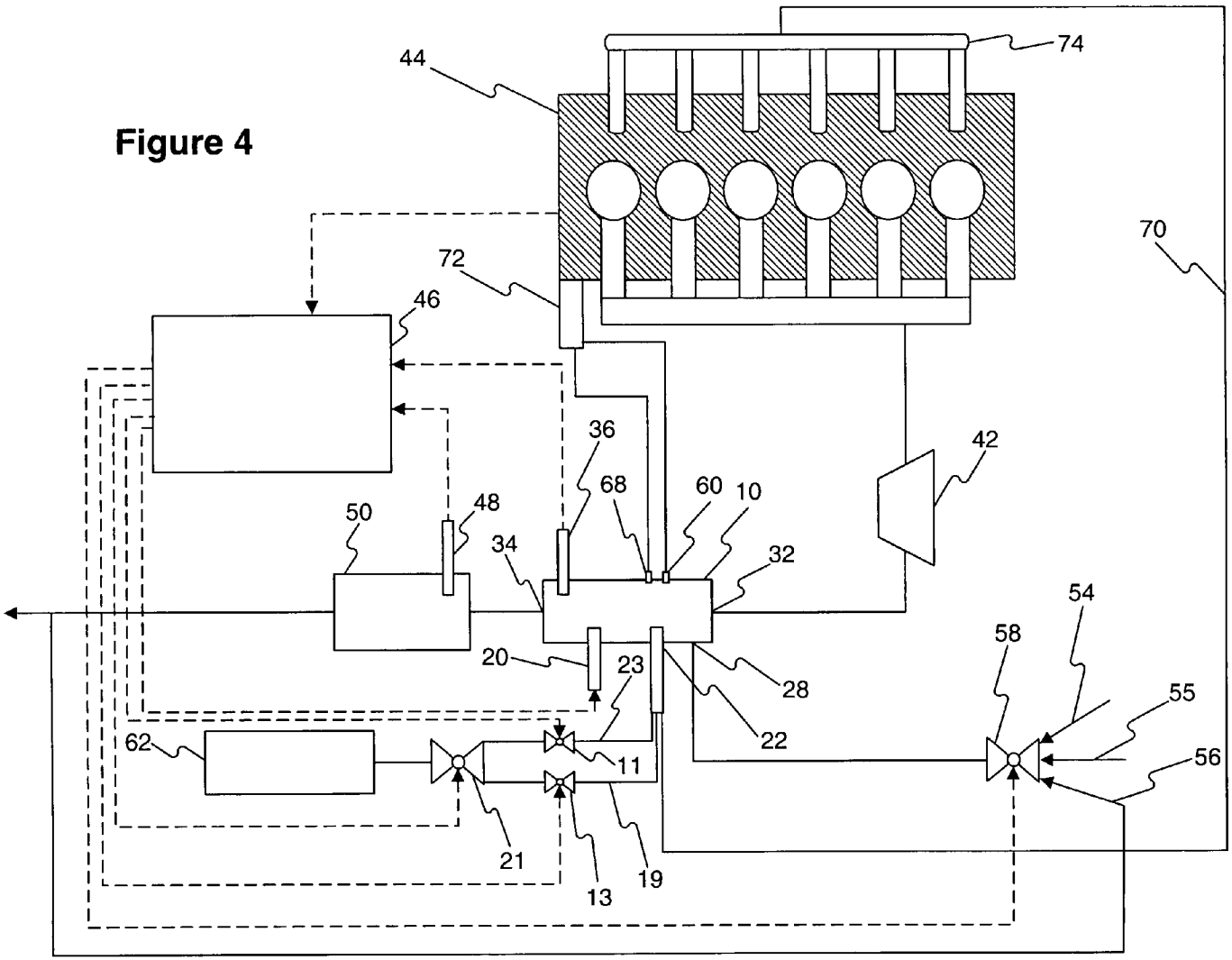
FIG. 4 is a diagrammatic illustration of a regeneration device connected to a power source according to yet another exemplary embodiment of the present disclosure.

In an exemplary embodiment, the injector 22 may be a dual orifice nozzle configured to controllably deliver two separate flows of fluid. As illustrated in FIG. 4, a combustible substance may be supplied to such an injector 22 through a pilot line 19 and a secondary line 23. The lines 19, 23 may be independently controlled by a corresponding pilot control valve 13 and secondary control valve 11, and/or any other conventional flow control device. As illustrated by the dashed lines in FIG. 4, the valves 13, 11 may be controllably connected to a controller 46. A supply valve 21 may be configured to controllably direct a flow of the combustible substance from a combustible substance source 62 to the valves 13, 11. The supply valve 21 may also be controllably connected to the controller 46.

The combustor head 16 may also include a coolant inlet 60 and a coolant outlet 68 proximate the injector 22. As illustrated in FIG. 4, the coolant inlet 60 may be fluidly connected to, for example, a coolant loop 72 of the power source 44. The coolant inlet 60 may direct coolant from the coolant loop 72 to a coolant passage (not shown) within the combustor head 16. The flow of coolant may cool a portion of the combustor head 16 proximate the injector 22 and may also conductively cool a portion of the injector 22. The coolant supplied to the combustor head 16 may exit the combustor head 16 through the coolant outlet 68 and may continue to flow through the coolant loop 72.

As illustrated in FIG. 4, a purge line 70 may also be fluidly connected to the injector 22. The purge line 70 may be fluidly connected to, for example, an intake manifold 74 of the power source 44. The purge line 70 may be configured to direct a flow of purge gas through the injector 22 once regeneration of the filter 50 is complete and the combustible substance is no longer supplied to the injector 22. The purge gas may force any of the combustible substance remaining in the injector 22 out of the injector 22 and into the flow of exhaust gas entering the regeneration assembly 10 through the exhaust inlet 32.

Referring again to FIG. 1, the swirler 24 may be any device capable of assisting in increasing the swirling motion and/or turbulence of a pressurized flow of fluid. The swirler 24 may be connected to the combustor head 16 and may be configured to assist in mixing a combustible substance supplied to the combustion chamber 18 with a flow of gas supplied to the combustion chamber 18. The swirler 24 may be formed from any of the materials discussed above with respect to the combustor head 16. In an exemplary embodiment, the swirler 24 and the combustor head 16 may be a one-piece assembly The swirler 24 may be any shape or configuration capable of inducing a swirling and/or substantially circular motion in a gas passing over its surface. The swirler 24 may be, for example, substantially conical or substantially disc-shaped, and may have one or more veins, holes, slits, fins, and/or any other structures known in the art. In an exemplary embodiment of the present disclosure, the swirler 24 may also have one or more moving parts.

It is understood that the circular motion of gas created by the swirler 24 may assist in mixing a combustible substance with a flow of gas. It is also understood that the swirling motion of the gas created by the swirler 24 may assist in directing a portion of the combustible substance delivered by the injector 22 to a wall of the combustion chamber 18. This motion may assist in accelerating the evaporation of fuel collected at the combustion chamber wall. Thus, the swirler 24 may assist in maintaining the temperature of the combustion chamber wall within desired limits. Such desired limits may correspond to the melting point of the combustion chamber wall. The motion of gas created by the swirler 24 may also result in a recirculation of hot combustion products back into a first combustion zone 40 defined by the combustion chamber 18. Recirculating products of the combustion process may assist in sustaining and/or stabilizing the combustion process.

As shown in FIG. 1, a stabilizer 26 may be fluidly connected to an end of the combustion chamber 18. The stabilizer 26 may be made of any of the metals and/or alloys discussed above. In an exemplary embodiment, the stabilizer 26 may be made of Nickel alloy HX. The stabilizer 26 may also be configured to assist in substantially isolating a combustion reaction occurring at the first combustion zone 40 from exhaust gases entering the housing 30 through the exhaust inlet 32. As used herein, the term "substantially isolating" means forming a permeable barrier between a first combustion zone and a second combustion zone while minimizing fluctuations in the flow of a fluid through one of the zones. For example, the stabilizer 26 may assist in minimizing flow fluctuation within the combustion chamber 18 resulting from sudden increases and/or decreases in exhaust flow being directed to a second combustion zone 38 through the exhaust inlet 32. Such sudden changes in exhaust flow may be caused by, for example, rapid increases and/or decreases in engine speed and/or load. The stabilizer 26 may also have a shape and/or configuration useful in maintaining a fluid connectivity between the first combustion zone 40 and the second combustion zone 38. For example, in such an embodiment, the stabilizer 26 may be a substantially circular disk having at least one hole.

Figure 2:
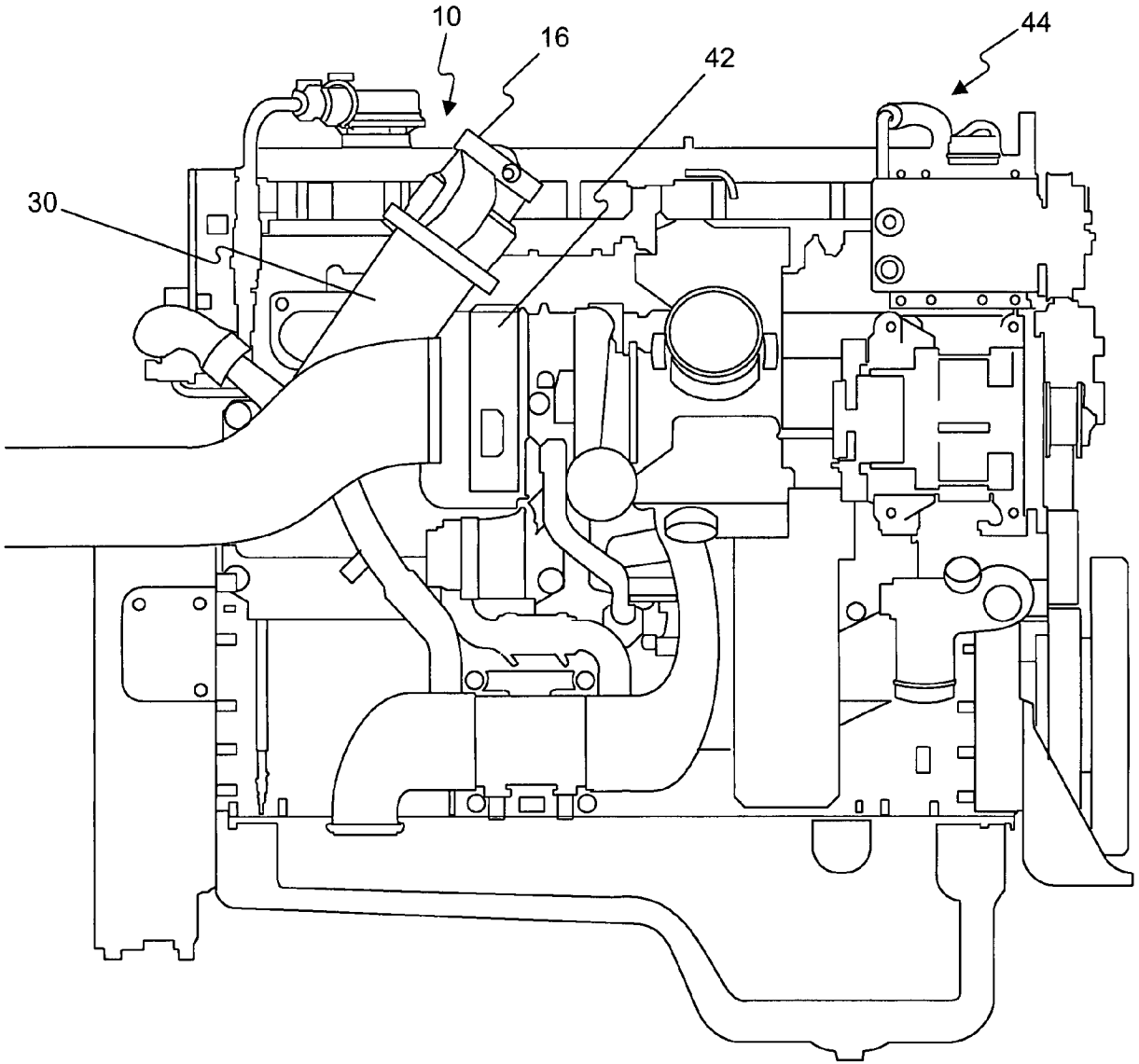
FIG. 2 is a diagrammatic illustration of a regeneration device connected to a power source according to another exemplary embodiment of the present disclosure.
Figure 3:
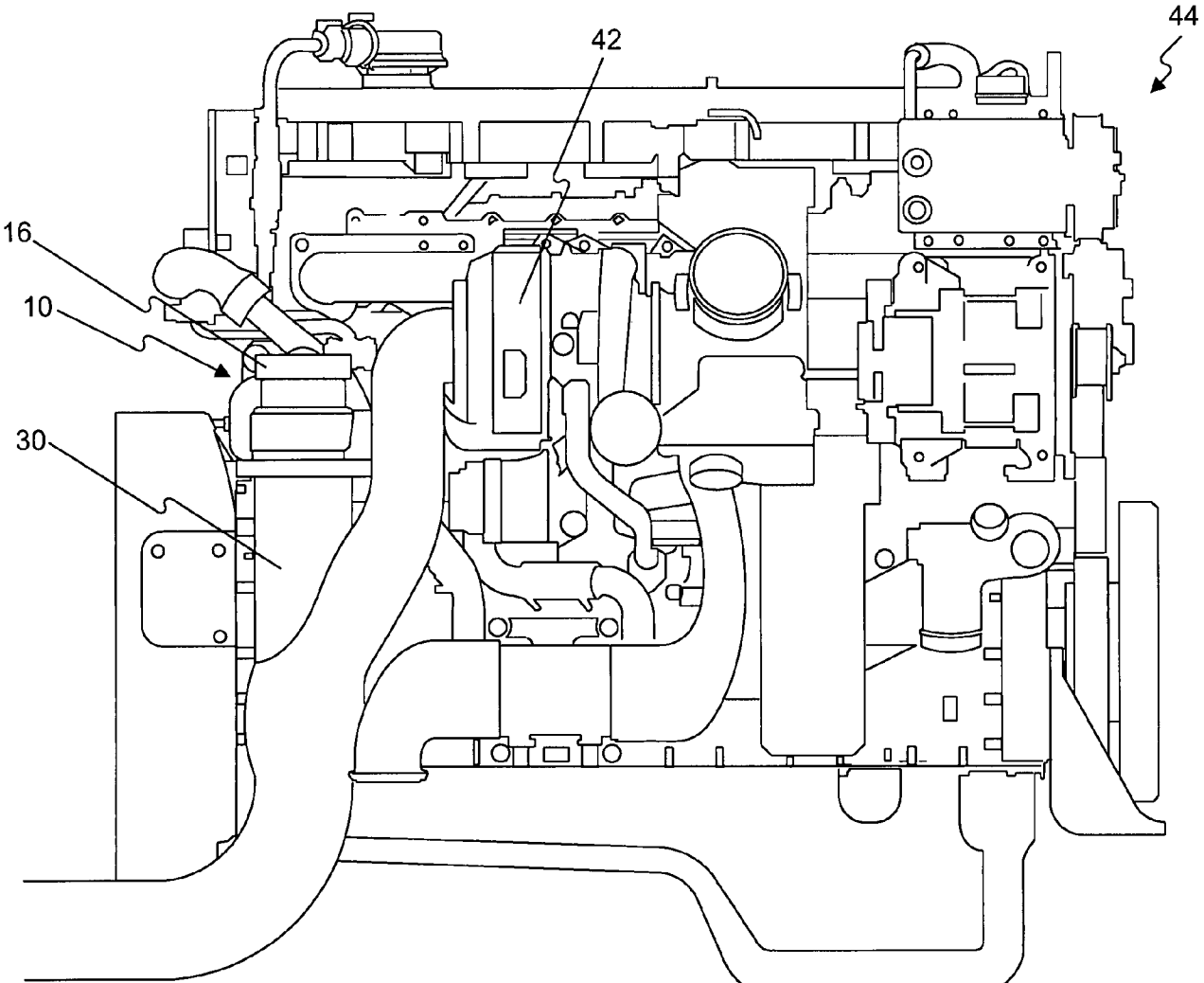
FIG. 3 is a diagrammatic illustration of a regeneration device connected to a power source according to still another exemplary embodiment of the present disclosure.

As discussed above, the housing 30 may be connected to the combustor head 16 such that the combustion chamber 18 may be disposed substantially within, and fluidly connected to, the housing 30. The housing 30 may be formed of any of the materials discussed above. The housing 30 may also be formed from, for example, a high silicone steel casting or other conventional high temperature material useful in combustion environments. The housing 30 may have any shape and/or configuration useful in minimizing restrictions on a flow of fluid through the housing 30, and/or minimizing the pressure drop experienced by the flow as it passes therethru. FIGS. 2 and 3 illustrate exemplary embodiments of such housings 30. It is understood that the size and shape of the housing 30 may depend on the type and/or size of the power source 44 to which the regeneration assembly 10 is connected. For example, the housing 30 may be fluidly connected to a turbine or other energy extraction assembly 42 and oriented substantially horizontally (FIG. 2), substantially vertically (FIG. 3), and/or any other direction with respect to the power source 44.

The housing 30 may be long enough to substantially completely contain a flame created by the ignitor 20 and the injector 22 during a combustion reaction. As shown in FIG. 1, the housing 30 may include an extension section 64 to assist in substantially completely containing the flame. The housing 30 may also include a bowed section 66. In one exemplary embodiment, the bowed section 66 may extend around substantially an entire circumference of the housing 30 and may be disposed substantially opposite the exhaust inlet 32. The bowed section 66 may facilitate more complete mixing of exhaust gases with an unburned combustible substance passing to the housing 30 from the combustion chamber 18. The bowed section 66 may also provide additional volume within the housing 30 to compensate for any bending of the flame caused by, for example, a flow of exhaust gas directed into the housing 30 through the exhaust inlet 32. As a result, the bowed section 66 of the housing 30 may assist in maintaining an outer surface of the housing 30 at a substantially uniform temperature. It is understood that the regeneration assembly 10 may include, for example, brackets, stabilizers, or other conventional support and/or dampening devices (not shown) to assist in supporting the regeneration assembly 10. Such devices may be connected to, for example, the power source 44 (FIGS. 2-4).

As mentioned above, the first portion 12 may be a universal component of the regeneration assembly 10. In an exemplary embodiment, a single combustor head 16/combustion chamber 18 assembly of the present disclosure may be sized and/or otherwise configured to connect to different housings 30 having different sizes, shapes and other configurations. In such an embodiment, each different housing 30 may be particularly fitted to conform to the power source 44 to which it is connected based on size and/or space constraints. It is understood that a portion of each different housing 30 may have substantially similar dimensions such that the universal combustor head 16 may connect thereto and the universal combustion chamber 18 may be disposed therein when the combustor head 16 is connected to the housing 30.

As discussed above, the housing 30 may assist in defining the second combustion zone 38 downstream of the combustion chamber 18. The housing 30 may also include the exhaust inlet 32 and an outlet 34. A portion of a diagnostic device 36 may be disposed within the housing 30 and configured to sense characteristics of a flow passing therethru. In an exemplary embodiment, the diagnostic device 36 may be disposed proximate the outlet 34 and/or the exhaust inlet 32 of the housing 30. The diagnostic device 36 may be, for example, a temperature, flow sensor, particulate sensor, and/or any other conventional sensor known in the art. The diagnostic device 36 may also be electrically connected to the controller (FIG. 4).

INDUSTRIAL APPLICABILITY

The disclosed regeneration assembly 10 may be used to assist in purging contaminants collected within filters through regeneration. Such filters may include any type of filters known in the art such as, for example, particulate filters useful in extracting pollutants from a flow of liquid. Such filters, and thus, the regeneration assembly 10, may be fluidly connected to an exhaust outlet of, for example, a diesel engine or other power source 44 known in the art. The power source 44 may be used in any conventional application where a supply of power is required. For example, the power source 44 may be used to supply power to stationary equipment such as power generators, or other mobile equipment, such as vehicles. Such vehicles may include, for example, automobiles, work machines (including those for on-road, as well as off-road use), and other heavy equipment.

The regeneration assembly 10 may be configured to raise the temperature of a flow of exhaust passing through it without undesirably restricting the flow. With minimal flow restriction, the regeneration assembly 10 may avoid creating backpressure within an exhaust conduit upstream of the regeneration assembly 10 and/or otherwise inhibiting power source performance. Further, the regeneration assembly 10 may be configured to generate an output flow at the outlet 34 with a desired elevated temperature. The regeneration assembly 10 may also be small enough to be packaged on the power source 44. As a result, the regeneration assembly 10 may be easily calibrated with the power source 44 by the power source manufacturer. The operation of the regeneration assembly 10 will now be described in detail with respect to FIG. 4 unless otherwise noted. It is understood that the dashed lines originating from and terminating at the controller 46 in FIG. 4 represent electrical or other control lines. The solid lines connecting each of the components of FIG. 4 represent fluid flow lines.

A flow of exhaust produced by the power source 44 may pass from the power source 44, through the energy extraction assembly 42, and into the regeneration device 10 through the exhaust inlet 32. It is understood that in an exemplary embodiment of the present disclosure, the energy extraction assembly may be omitted. Under normal power source operating conditions, the regeneration assembly 10 may be deactivated and the flow of exhaust may pass through the outlet 34 and through a particulate filter 50 where a portion of the pollutants carried by the exhaust may be captured. Over time, however, the filter 50 may become saturated with collected pollutants, thereby hindering its ability to remove pollutants from the flow of exhaust. A diagnostic device 48 configured to sense characteristics of the filtered flow and/or the filter 50 may be fluidly connected to the filter 50 and may be electrically connected to the controller 46. The diagnostic device 48 may detect, for example, filter temperature, flow rate, flow temperature, filtered flow particulate content, and/or other characteristics of the filter 50 and/or the flow. The diagnostic device 48 may send this information to the controller 46 and the controller 46 may use the information to determine when the filter 50 requires regeneration. As illustrated by the dashed lines in FIG. 4, it is understood that the controller 46 may also utilize sensed information from other system components, such as, for example, the power source 44 and the diagnostic device 36 connected to the regeneration assembly 10. This determination may also be based on a predetermined regeneration schedule, the gallons of fuel burned by the power source 44, and/or models, algorithms, or maps stored in a memory of the controller 46.

To begin operating the regeneration assembly 10, the controller 46 may at least partially open a mixing valve 58 to permit a small amount of additional gas into the regeneration assembly 10 through the gas inlet 28. The gas may be a flow of ambient air 54 containing, among other things, oxygen. The gas may also include a flow of filtered exhaust 56 extracted from downstream of the filter 50 and directed through the mixing valve 58. The gas may further include a flow of compressed air 55 directed to the regeneration assembly 10 from, for example, a compressor assembly (not shown) or the intake manifold 74 of the power source 44. The controller 46 may also activate the ignitor to create, for example, a spark proximate the combustion chamber 18. The controller 46 may at least partially open the supply valve 21, thereby directing a flow of a combustible substance from the combustible substance source 62 to the injector 22. As discussed above, in an embodiment of the present disclosure, the controller 46 may also at least partially open the pilot control valve 13 and/or the secondary control valve 11 to assist in controlling the flow of the combustible substance. It is understood that the combustible substance may be, for example, gasoline, diesel fuel, reformate, or any other conventional combustible fluid. Hereinafter, the combustible substance will be referred to as fuel.

The swirler 24 (FIG. 1) may direct the gas from the gas inlet 28 in a swirling motion within the combustion chamber 18 (FIG. 1). This swirling may assist the fuel in mixing with the gas. The gas/fuel mixture may ignite in the presence of the spark from the ignitor 20, and a portion of the injected fuel may combust in the first combustion zone 40 (FIG. 1). In an embodiment of the present disclosure, the controller 46 may direct a minimal volume of gas to the gas inlet 28 of the regeneration device 10. This minimal volume of gas may contain just enough oxygen to initiate combustion within the combustion chamber 18. As a result, the fuel injected may only partially combust within the combustion chamber 18. In such an embodiment, a combustion chamber 18 having a smaller volume than conventional regeneration assembly combustion chambers may be used. As a result, the overall size of the regeneration assembly 10 of the present disclosure may be less than the overall size of conventional regeneration assemblies in which fuel is burned. It is understood that oxygen contained within the flow of exhaust entering the regeneration assembly 10 through the exhaust inlet 32 may be used to complete the combustion of the injected fuel in the second combustion zone 38 (FIG. 1). The combustion zones 40, 38 are substantially isolated from each other by the stabilizer 26 (FIG. 1) during operation of the regeneration assembly 10.

The controller 46 may control the amount of fuel injected based on the desired temperature required for regeneration. It is understood that as more fuel is injected, the temperature of the flow exiting the outlet 34 will increase. The controller 46 may also control the relative amount of gas supplied to the gas inlet 28 based on the amount of fuel injected and the desired temperature. The desired temperature may be, for example, the temperature of the exhaust flow at the outlet 34 of the regeneration assembly 10 causing the filter 50 to regenerate at a desired rate or within a desired time. It is understood that such desired temperatures may be greater than approximately 500° Celsius.

Once the desired temperature has been reached, the filter 50 may begin to regenerate and the materials collected therein may begin to burn away. The regeneration assembly 10 may continue to combust fuel until the filter 50 has been satisfactorily regenerated. During regeneration, coolant may be supplied to the combustor head 16 to cool a portion of the combustor head 16 proximate the injector 22.

After the controller 46 determines regeneration is complete, the supply of fuel and gas to the regeneration assembly 10 may cease, and the ignitor 20 may be deactivated. The controller 46 may also direct a flow of purge gas from the intake manifold 74 of the power source 44 to the injector 22. This flow of purge gas may purge the injector 22 of any remaining fuel contained therein and may assist in minimizing, for example, the amount of carbon build-up in the injector 22 resulting therefrom.

It will be apparent to those having ordinary skill in the art that various modifications and variations can be made to the disclosed regeneration assembly 10 without departing from the scope of the invention. Other embodiments of the invention will be apparent to those having ordinary skill in the art from consideration of the specification and practice of the invention disclosed herein. It is intended that the specification and examples be considered as exemplary only, with a true scope of the invention being indicated by the following claims and their equivalents.

What is claimed is:

1. A regeneration assembly, comprising:

a first portion including a combustion chamber connected to a combustor head, the combustor head including an inlet configured to direct a flow of filtered exhaust gas to the combustion chamber, the flow of filtered exhaust gas having at least a portion of particulates removed therefrom; and a second portion including a housing, the housing including an exhaust gas inlet configured to direct a flow of exhaust gas to a combustion zone within the housing, the first portion being removably connectable to the second portion;

wherein the inlet in the combustor head is configured to inject a first amount of oxygen for initiating combustion of a combustible substance in the combustion chamber, and the first amount of oxygen is a volume of oxygen sufficient to enable only partial combustion of the combustible substance in the combustion chamber.

2. The regeneration assembly of claim 1, wherein the combustion chamber of the first portion is disposed substantially within the housing of the second portion.

3. The regeneration assembly of claim 1, wherein the inlet in the first portion is configured to direct compressed air to the combustion chamber.

4. The regeneration assembly of claim 1, further including a stabilizer connected to the combustion chamber and configured to assist in isolating a first combustion zone within the combustion chamber from a second combustion zone within the housing.

5. The regeneration assembly of claim 1, wherein the combustion zone is downstream of the combustion chamber.

6. The regeneration assembly of claim 1, further including a connection assembly configured to assist in removably connecting the first portion to the second portion.

7. The regeneration assembly of claim 1, further including an ignitor connected to the combustor head and at least partially disposed within the combustion chamber.

8. The regeneration assembly of claim 1, wherein the inlet is fluidly connected to a mixing valve configured to receive the flow of filtered exhaust gas and a flow of at least one of ambient air and compressed air.

9. The regeneration assembly of claim 1, wherein the flow of filtered exhaust gas is extracted downstream of a filter disposed downstream of the regeneration assembly.

10. The regeneration assembly of claim 1, wherein the exhaust gas inlet is configured to direct substantially an entire flow of exhaust gas output from a power source to the combustion zone within the housing of the second portion.

11. The regeneration assembly of claim 1, further including an injector connected to the combustor head and configured to inject the combustible substance into the combustion chamber.

12. The regeneration assembly of claim 11, further including a swirler configured to assist in mixing a flow of gas with the combustible substance within the combustion chamber.

13. The regeneration assembly of claim 1, wherein the combustor head further includes a coolant passage fluidly connected to a coolant loop of a power source.

14. The regeneration assembly of claim 13, wherein the coolant passage is configured to direct a flow of coolant to a portion of the combustor head proximate an injector of the regeneration assembly.

15. The regeneration assembly of claim 14, wherein the flow of coolant assists in conductively cooling a portion of the injector.

16. A regeneration assembly, comprising:

a first portion including a combustion chamber connected to a combustor head, the combustion chamber defining a first combustion zone;

a second portion including a housing defining a second combustion zone, the combustion chamber of the first portion being disposed substantially within the housing, the first combustion zone being substantially isolated from the second combustion zone by a stabilizer connected to the combustion chamber and wherein the first portion is configured to individually mate with any one of a plurality of second portions of different configurations;

an injector connected to the combustor head and configured to inject a combustible substance into the combustion chamber; and a gas inlet in the combustor head configured to inject a first amount of oxygen for initiating combustion of the combustible substance in the first combustion zone of the regeneration assembly, the first amount of oxygen being a volume of oxygen sufficient to enable only partial combustion of the combustible substance in the combustion chamber.

17. The regeneration assembly of claim 16, further including a swirler configured to assist in mixing a flow of gas including the first amount of oxygen with the combustible substance within the combustion chamber.

18. The regeneration assembly of claim 16, wherein the housing further includes an exhaust gas inlet configured to direct a flow of exhaust gas to the second combustion zone.

19. The regeneration assembly of claim 16, further including a connection assembly configured to assist in removably connecting the first portion to the second portion.

20. The regeneration assembly of claim 16, wherein the controller is configured to control the amount of oxygen directed to the gas inlet based on at least one of an amount of the combustible substance injected into the combustion chamber and a desired temperature of a flow of exhaust gas at an outlet of the regeneration assembly.

21. The regeneration assembly of claim 16, wherein:

the gas inlet is configured to direct a flow of gas including the first amount of oxygen to the combustion chamber; and the flow of gas comprises at least one of ambient air, compressed air, and recirculated exhaust gas.

22. The regeneration assembly of claim 21, wherein the flow of gas comprises a flow of filtered exhaust gas.

23. The regeneration assembly of claim 22, wherein the inlet is fluidly connected to a mixing valve configured to receive the flow of filtered exhaust gas and a flow of at least one of ambient air and compressed air.

24. The regeneration assembly of claim 22, wherein the flow of filtered exhaust gas is extracted downstream of a filter disposed downstream of the regeneration assembly.

25. The regeneration assembly of claim 16, further including an ignitor connected to the combustor head and at least partially disposed within the combustion chamber.

26. The regeneration assembly of claim 25, wherein the ignitor is configured to ignite a combustible substance within the combustion chamber.

27. The regeneration assembly of claim 16, wherein the combustor head further includes a coolant passage fluidly connected to a coolant loop of a power source.

28. The regeneration assembly of claim 27, wherein the coolant passage is configured to direct a flow of coolant to a portion of the combustor head proximate an injector of the regeneration assembly.

29. A method of regenerating a filter using a regeneration assembly, comprising:

injecting a flow of a combustible substance into a first combustion zone of the regeneration assembly;

directing a first amount of oxygen for initiating combustion of the combustible substance to the first combustion zone of the regeneration assembly;

partially combusting the combustible substance in the first combustion zone;

directing a flow of exhaust to a second combustion zone of the regeneration assembly; and substantially completely combusting a remainder of the injected flow of the combustible substance in the second combustion zone.

30. The method of claim 29, further including mixing a portion of the flow of the combustible substance with the first amount of oxygen.

31. The method of claim 29, wherein the first combustion zone is substantially isolated from the second combustion zone.

32. The method of claim 29, wherein directing the first amount of oxygen to the first combustion zone includes directing a flow of compressed air to the first combustion zone.

33. The method of claim 29, further including controlling the amount of oxygen directed to the gas inlet based on at least one of an amount of the combustible substance in the first combustion zone and a desired temperature of a flow of exhaust gas at an outlet of the regeneration assembly.

34. The method of claim 29, further including controlling an amount of the combustible substance directed to the first combustion zone based on a desired temperature of a flow of exhaust gas at an outlet of the regeneration assembly.

35. The method of claim 29, wherein the first amount of oxygen is a volume of oxygen sufficient to enable only partial combustion of the combustible substance in the combustion chamber.

36. The method of claim 29, further including increasing the temperature of the flow of exhaust to a desired temperature.

37. The method of claim 36, wherein the desired temperature is a regeneration temperature of a filter fluidly connected downstream of the regeneration assembly.

38. The method of claim 29, wherein directing the first amount of oxygen to the first combustion zone includes directing a flow of filtered exhaust gas to the first combustion zone.

39. The method of claim 38, further including directing to the first combustion zone the flow of filtered exhaust gas extracted downstream of the filter disposed downstream of the regeneration assembly.

40. The method of claim 38, wherein:

the flow of filtered exhaust directed to the first combustion zone is provided to initiate combustion in the first combustion zone; and the flow of exhaust gas directed to the second combustion zone is provided to substantially complete combustion in the second combustion zone.

41. The method of claim 29, further including directing a flow of coolant to the combustor head to cool at least a portion of the combustor head.

42. The method of claim 41, wherein the coolant is supplied from a coolant loop of a power source.

* * * * *